US006280288B1

(12) United States Patent
Gaeta et al.

(10) Patent No.: US 6,280,288 B1
(45) Date of Patent: Aug. 28, 2001

(54) PROCESS FOR DETERMINING OPTIMUM GRINDING CONDITIONS

(75) Inventors: Anthony C. Gaeta, Lockport; Paul Wei, Latham; Gwo Shin Swei, East Amherst, all of NY (US); Thomas G. Kinisky, Shrewsbury, MA (US)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 09/499,109

(22) Filed: Feb. 4, 2000

(51) Int. Cl.[7] ..... B24B 49/00; B24B 51/00
(52) U.S. Cl. ..... 451/5; 451/28
(58) Field of Search ..... 451/28, 5, 8; 438/14, 438/15, 462, 973; 148/DIG. 162

(56) References Cited

U.S. PATENT DOCUMENTS 5,888,838 * 1/2001 Mendelson et al. ..... 438/15
6,171,873 * 1/2001 Mendelson et al. ..... 438/14

* cited by examiner

*Primary Examiner*—Derris H. Banks
(74) *Attorney, Agent, or Firm*—David Bennett

(57) ABSTRACT

The invention provides a useful tool for advising customers for abrasive tools on the selection of optimum grinding conditions for the use of a specific tool wherein the tool is in the form of a performance map generated from a plurality of data points obtained by measuring performance for a plurality of combinations of the two key grinding process variables.

8 Claims, 4 Drawing Sheets

PROCESS FOR DETERMINING OPTIMUM GRINDING CONDITIONS

BACKGROUND OF INVENTION

The present invention relates to grinding tools such abrasive wheels and coated abrasive belts and discs. When a new grinding tool is developed it represents a complex series of selections of alternatives. For example a new abrasive belt involves the selection of a backing, any backing treatment used, abrasive grit nature, abrasive grit size, binder, filler, other additives, surface treatments, and so on. This belt therefore will not perform at exactly the same performance level under identical conditions as previously made belts. Add to this the variation of the different designs of grinding machines with which the belt might be used, the coolants that might be used, the belt and workpiece speeds and so on, and the problem of using the belt to the best effect becomes overwhelming. In practice the operator is often left to find the best conditions for himself by trial and error. More commonly however, the machine settings are determined by long usage on previous belts and the new belt is operated under the same conditions regardless of whether these represent the optimum conditions for the new belt on that machine.

The result of the previous usages is often inefficient operation and sometimes the rejection of genuinely useful new products because they are incapable of performing at previously approved levels under the traditionally used sets of conditions.

There is therefore a need for a process for generating easily understood information that is helpful in determining how a grinding tool might be used with optimum effect. The present invention provides such a process and generates a unique means for conveying the information to an operator using the tool.

GENERAL DESCRIPTION OF THE INVENTION

The present invention provides a process for identifying optimum grinding conditions for the use of a specific grinding tool which comprises:

a) operating a grinding machine incorporating a specific grinding tool on a specific substrate at a first set of process conditions;

b) measuring the grinding performance of the grinding tool under said first set of process conditions;

c) repeating steps a) and b) at a plurality of further sets of different values of the same process conditions; and d) using the grinding performance data to generate a topographical map identifying the combinations of conditions in which optimum grinding performance results were obtained.

The key to the above process is the topographical map generated from the data. As used herein the term "topographical" is intended to convey a map in which sets of conditions which would give identical performance are connected by lines in much the way the contour lines on a map connect points of equal elevation above sea level. Such topographical maps can be generated by computer-aided statistical manipulation of data points obtained in a routine manner in an initial evaluation of a new tool on a given machine operating on a given substrate. Thereafter the map is effective for the same combination of machine, tool and substrate, wherever the grinding takes place. It therefore becomes possible to guide a new user of a tool to identify exactly the conditions under which the best results will be obtained.

The topographical map can be generated in actual or simulated three dimensions, (with or without color coding such as are used in conventional geographical maps), but generally it is more useful if the map is two dimensional with different colors indicating the different levels of performance. For example a red color might be used to indicate the area within which the optimum grinding performance might be obtained with blue indicating conditions in which the worst performance might be expected. Intermediate levels can be indicated by varying shades from red, through orange and yellow and green, to blue.

The data points used to produce the map can be generated on the specific machine in connection with which the information is to be used, or alternatively it can be generated on an identical machine at a remote location depending on the availability of machine downtime to conduct the preliminary data generation. The "tool" used to generate the data, as the term is used herein, can be for example a grinding wheel, such as an organic, vitreous, rubber or metal bonded wheel or a composite abrasive wheel in which abrasive particles are bonded to the fibers of a tangled fibrous substrate; a bonded abrasive segment or mounted point; a composite abrasive pad or block; or a coated abrasive such as a belt, disc or sheet. Other options could also be devised for use with the present invention. Likewise the "machine" in connection with which the tool is used can be any commercial device for contacting an abrasive tool with a substrate, which itself can be any substrate conventionally treated with an abrasive tool to remove material or improve the surface finish of a substrate such as a metal, wood, ceramic or a painted surface.

In addition to identifying optimum use conditions, the procedure can be use to select between options of tool design. Thus when, for example, two belt designs are available for use in a particular grinding operation, the production of a performance map enables the user to determine which would be the most cost-effective in the preferred use conditions employed. This can be done for example by measuring the critical performance parameters for both belts under the same range of process conditions, and plotting, instead of the parameter itself, the ratio of the critical performance parameters for the two belts under the same sets of process conditions. In practice this is best done by generating an equation representing the variation of the process conditions and the value of the critical parameter being measured for each belt, then using these equations to predict the critical process parameter for each belt at a set of combinations of process conditions and the ratio of the critical parameter obtained for each belt at each set of process conditions. This statistically adjusts each measurement to give a higher confidence level in the value used and therefore the ratio between the two. It is this statistically more reliable ratio that is preferably plotted to give the comparative product map. Such a map will show clearly the degree of improvement, (if any), of one over the other under a wide range of process conditions. The selection of the appropriate design can thereafter be based on solid data rather than on perceptions based on incomplete data.

Where the tool is a coated abrasive belt, used on a conventional machine to treat a metal substrate, the design of the machine will often pre-determine conditions such as area of contact and belt dimensions. Other conditions such as pressure of contact between the belt and the substrate, time of contact and intervals between contacts, lubricant/coolant used and so on can however be changed. The measure of quality of the grinding performance might be metal removal rate, number of parts treated before the belt needs to be replaced or the surface finish of the substrate. In these circumstances it is necessary to identify the two most important variables and keep all other variables constant throughout the data collection operations which focus on the measurement of the parameter that is most indicative to the user of "quality". Thus in a concrete situation, the key variables monitored could be pressure and contact time and the "quality" variable might be the number of parts that could be finished to the desired quality in a given period. A topographical chart generated on the basis of the data collected would immediately inform the operator how best to use the new belt on his machine by selecting the pressure and contact time indicated by the chart as offering the optimum number of parts produced in a unit time. Another example of the use of the process of the present invention relates to the selection of an appropriate coated abrasives with an engineered surface. These are coated abrasives in which the abrasive surface is in the form of repeating shapes comprising abrasive particles dispersed in a cured binder disposed on a backing material. Much depends on the contours of the repeating shapes which frequently have the form of structures that diminish in width with distance from the plane of the backing. The shapes can be in the form of parallel ridges, pyramids with square or triangular bases, or somewhat rounded shapes. Coated abrasives of this type are described for example in U.S. Pat. Nos. 5,014,468; 5,152,917; 5,454,844; 5,489,235; 5,672,097; 5,681,217; 5,833,724; 5,840,088; and 5,863,306; Within these variations it is possible to vary the size, spacing, frequency of repetition and so on of the structures, as well as the materials used to form the structures. Production of performance maps of the various alternatives helps decide with design is best for use on machines in which the machine design or established conditions of use effectively restrict the opportunities for varying the conditions of use. In a sense then performance mapping allows the selection of the optimum belt design from among available options for the specific application. This is a very effective way of ensuring that the customer receives optimum and demonstrable value from his belt purchase. As can well be appreciated the process described herein is a very valuable adjunct to the sales process, since a salesman can demonstrate to a potential user exactly how the tool he is offering can improve his productivity and even why his tool may be better suited to a specific operation than a competing tool that is currently being used.

DESCRIPTION OF PREFERRED EMBODIMENTS

The invention is now described with particular reference to specific examples of the use of the process of the invention to advise on the selection of grinding conditions. These are to be understood as merely exemplifying how the process of the invention and the property maps generated thereby might be used to advise a purchaser of abrasive products and not to indicate that closely similar applications are the only ones to which the process of the invention could be adapted.

The performance maps themselves can be generated from the collected data points using any one of a number of statistical manipulating devices such as the EXCEL™ package from Microsoft Corporation or the STATISTICA™ (6.0 version) from Stat-Soft Corporation. They can also take a number of forms providing they indicate adequately the performance level variation, (or comparison), at a variety of operating process conditions such that optimum conditions, (or option), can be identified.

EXAMPLE 1

In this Example a performance map was developed for a coated abrasive belt A, operating on a 304 stainless steel metal sample. The test performed employed as the test piece a 304 stainless steel ring with an OD of five inches and a thickness of one half inch. The workpiece was contacted with the belt under evaluation at a constant pressure during each run using a 40 Durometer rubber contact wheel and the workpiece was rotated at 12 rpm during the grinding. The belt speed was controlled to a fixed sfpm value during each grinding operation which was air-cooled.

Before each run the workpiece was weighed and grinding was continued for 2 minutes after which the workpiece was weighed again; 8 times for intermediate pressures for a total of 16 minutes; and 15 times at the highest pressures for a total of 30 minutes). Values were extrapolated, (where necessary) to give the metal removed after 30 minutes.

Figure 1A:
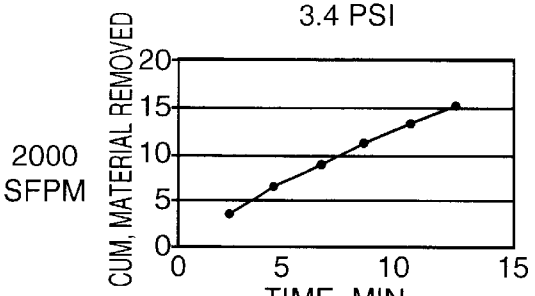
FIG. 1 is a series of linear graphs relating to Example 1 and FIGS. 2 and 3 are product performance maps produced as described in Example 1.
Figure 1B:
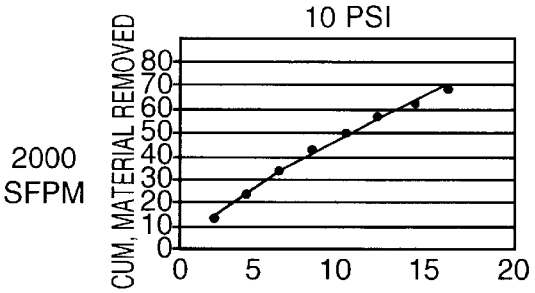
Figure 1C:
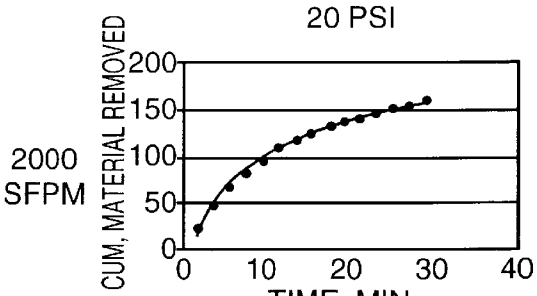
Figure 1D:
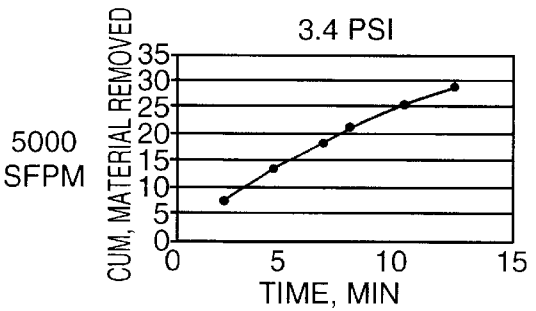
Figure 1E:
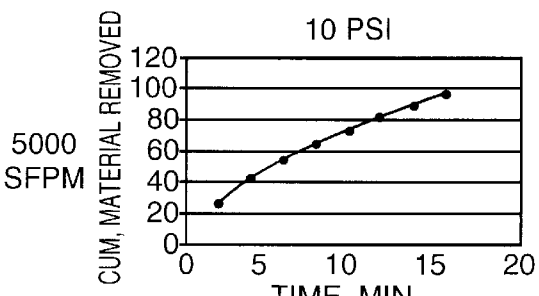
Figure 1F:
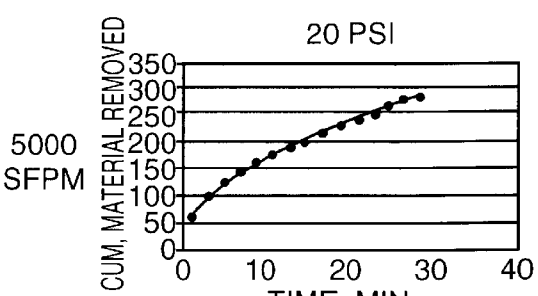
Figure 1G:
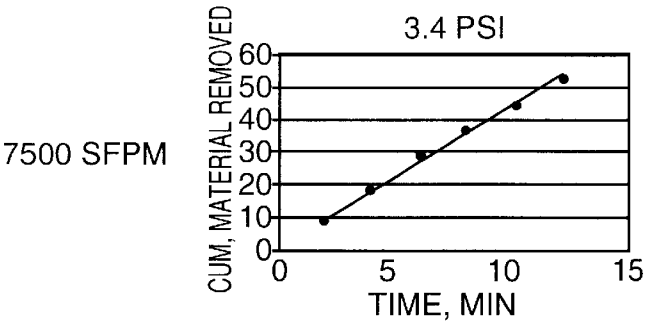
Figure 1H:
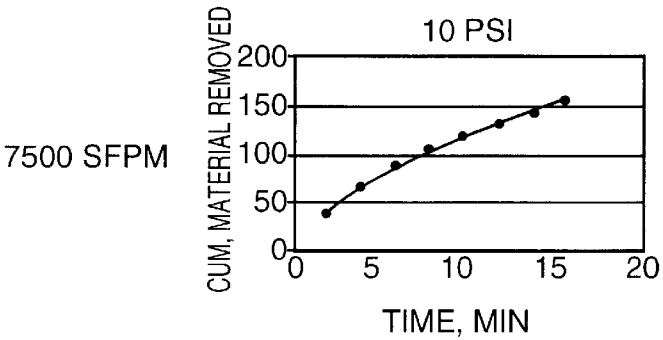
Figure 1I:
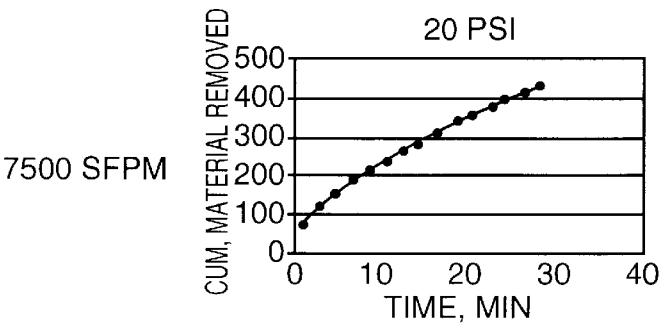
Figure 2:
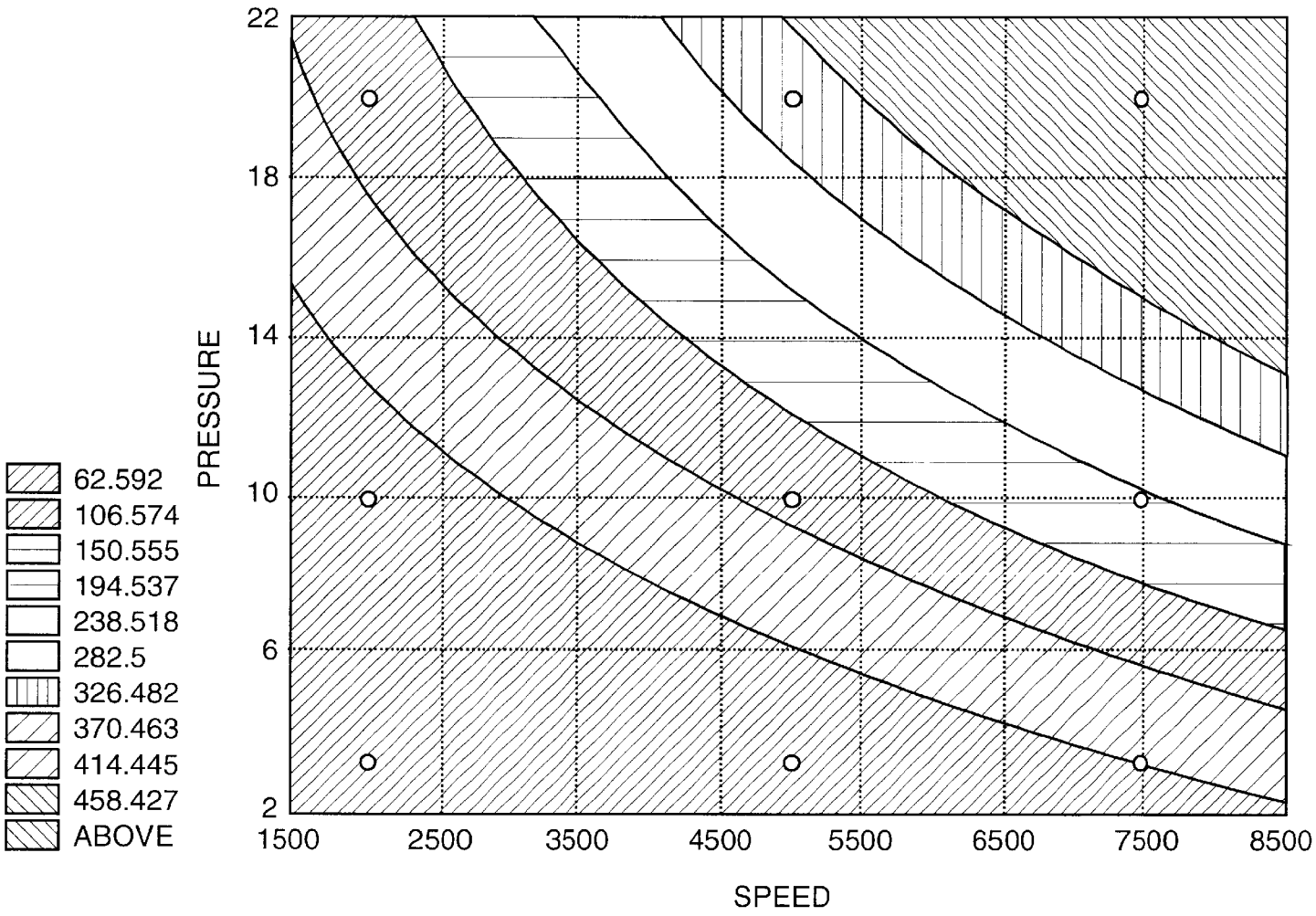

In the first stage data was collected with the belt operating at speeds of 2000, 5000 and 7500 sfpm and constant pressure of 3.4 psi. The metal removed was measured at two minute intervals along with the temperature reached by the workpiece. This was repeated six times for a total of 12 minutes. The same sequence of evaluations was carried out at applied pressures of 10 psi and then at 20 psi. The result was a series of graphs as shown in FIG. 1. This shows metal removed but it could also be plotted for temperature reached or some other significant parameter. These graphs, where necessary, were extrapolated to determine the metal removed after 30 minutes of grinding and the collected 30 minute metal removal values were used to generate a contour map with belt speed and applied pressure plotted along the axes and different colors used to represent different levels of metal removal. The map was generated using a software package available from Stat Soft Corporation under the trade name "Statistica 6.0". The map obtained is presented as FIG. 2 which shows that, with Belt A, the best performance is obtained at higher pressures and higher belt speeds. This map enables the user to select the optimum grinding conditions with this particular belt.

Figure 3:
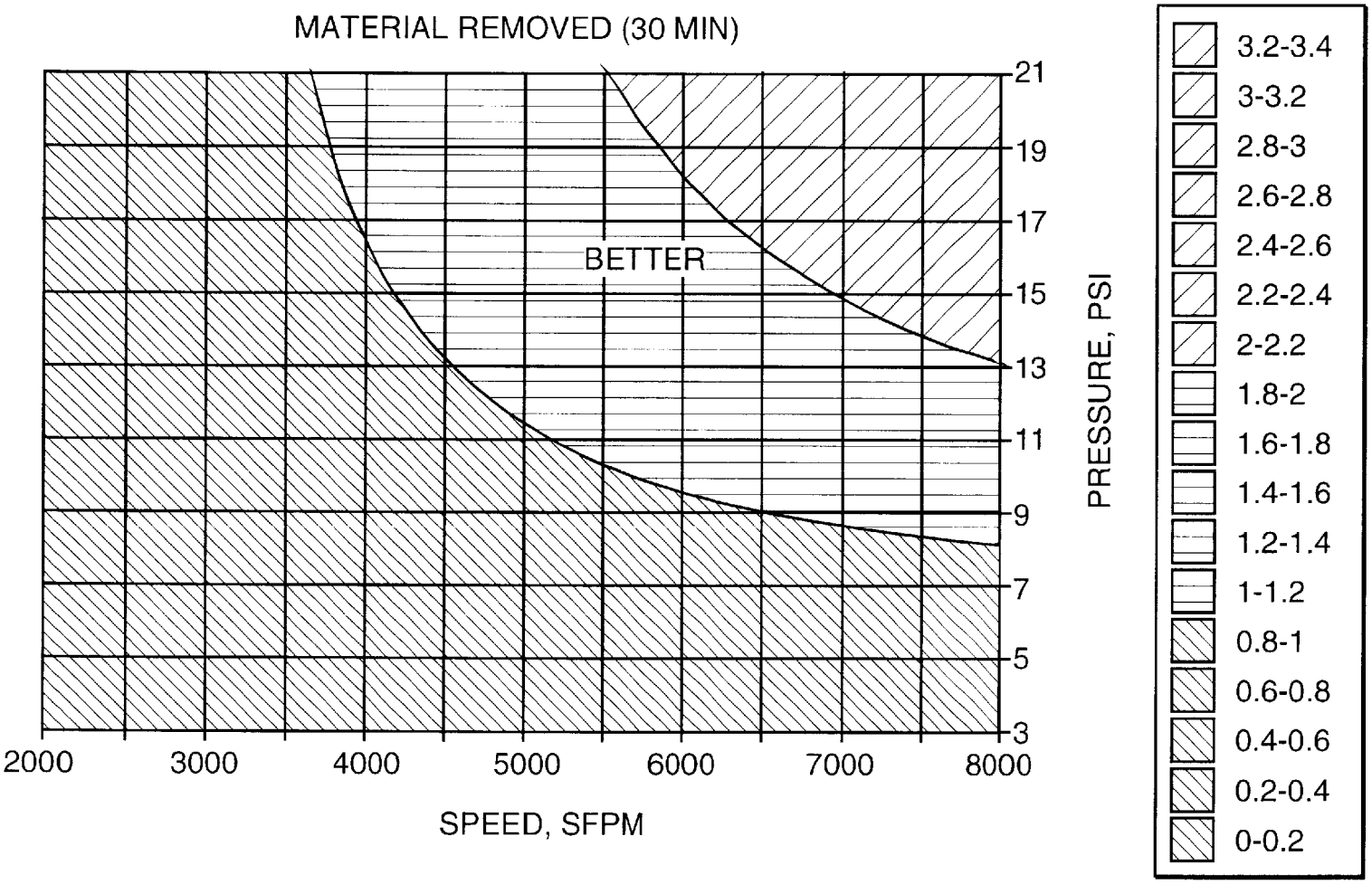

When it is necessary to determine which of two belts, A and B, of different designs gives the better performance, it is possible to extend the procedure described above by developing the same raw data as was secured above and then developing equations for the relationship between metal removed as a function of belt speed and time of grinding for each belt. These equation were then used to predict the metal removed at a number of combinations of conditions for both belts and the ratios of the metal removed by Belt A and by Belt B at each of the same combinations of process conditions were determined on the basis of these values. These ratios can then be plotted exactly as were the metal removal rates in FIG. 2. The result is the comparative performance map shown in FIG. 3 which indicates clearly that belt A is always better than B but that the degree of superiority is greatest at low belt speeds and low pressures.

What is claimed is:

1. A process for identifying optimum grinding conditions for the use of a specific grinding tool which comprises:

a) operating a grinding machine incorporating a specific grinding tool on a specific substrate at a first set of two process variables and generating data relating to grinding performance under such process variables;

b) measuring the grinding performance data of the grinding tool under said first set of two process variables;

c) repeating steps a) and b) at a plurality of further different sets of said two process variables; and d) using the grinding performance data to generate a topographical map identifying the combinations of said process variables in which optimum grinding performance results were obtained.

2. A process according to claim 1 in which the grinding tool is a coated abrasive belt.

3. A process according to claim 2 in which the coated abrasive belt has an engineered surface.

4. A process according to claim 2 in which the process variables measured are selected from the group consisting of the contact pressure between the belt and a substrate, length of such grinding contact, and length of intervals between grinding contact between the belt and a substrate.

5. A process according to claim 2 in which the grinding performance is determined by measurement of a parameter selected from the group consisting of: the surface finish of the substrate after grinding; number of parts finished to a predetermined standard within a specified time period; and the amount of substrate removed.

6. A process for generating a comparative performance map for two abrasive tools which comprises:

a) operating a grinding machine incorporating a first grinding tool on a specific substrate at a first set of process variables so as to generate data relating to grinding performance under such process variables;

b) measuring the grinding performance data of the grinding tool under said first set of process variables;

c) repeating steps a) and b) at a plurality of further sets of different vales of the same process variables;

d) repeating steps a) through c) with a second tool and generating a ratio of grinding performances for first and second grinding tools at each of the further sets of process variables selected in step c); and e) generating a comparative performance map showing the ratios of performances of the first and second grinding tools at a range of conditions.

7. A product performance indicator in which a range of performance levels are visually displayed in the form of a topographical map obtained by:

a) operating a grinding machine incorporating a specific grinding tool on a specific substrate at a first set of process variables so as to generate data relating to grinding performance under such process variables;

b) measuring the grinding performance data of the grinding tool under said first set of process variables;

c) repeating steps a) and b) at a plurality of further sets of different values of the same process variables; and d) computer-generating from the grinding performance data at such further sets of different values of same process variables a product performance indicator in the form of a topographical map identifying the combinations of process variables in which optimum grinding performance results were obtained.

8. A product performance indicator in which a range of performance levels are visually displayed in the form of a topographical map obtained by:

a) operating a grinding machine incorporating a first grinding tool on a specific substrate at a first set of process variables so as to generate data relating to grinding performance under such process variables;

b) measuring the grinding performance data of the grinding tool under said first set of process variables;

c) repeating steps a) and b) at a plurality of further different sets of process variables;

d) repeating steps a) through c) with a second tool and generating a ratio of grinding performances for first and second grinding tools at each of the different sets of process variables; and e) generating a comparative performance map showing the ratios of performances of the first and second grinding tools at a range of process variables.

* * * * *